US009656510B2

(12) United States Patent
Pagan

(10) Patent No.: US 9,656,510 B2
(45) Date of Patent: May 23, 2017

(54) WRITING DEVICE WITH PENCIL SHARPENER BUILT THEREIN

(71) Applicant: Luis Javier Pagan, Dublin, OH (US)

(72) Inventor: Luis Javier Pagan, Dublin, OH (US)

( * ) Notice: Subject to any disclaimer, the term of this patent is extended or adjusted under 35 U.S.C. 154(b) by 0 days.

(21) Appl. No.: 14/860,929

(22) Filed: Sep. 22, 2015

(65) Prior Publication Data

US 2016/0129724 A1 May 12, 2016

Related U.S. Application Data

(60) Provisional application No. 62/078,690, filed on Nov. 12, 2014.

(51) Int. Cl.

| | |
|---|---|
| ***B43K 29/06*** | (2006.01) |
| ***B43K 19/02*** | (2006.01) |
| ***B43K 29/00*** | (2006.01) |

(52) U.S. Cl.

CPC ..... *B43K 29/06* (2013.01); *B43K 19/02* (2013.01); *B43K 29/004* (2013.01)

(58) Field of Classification Search

CPC combination set(s) only.
See application file for complete search history.

(56) References Cited

U.S. PATENT DOCUMENTS

| | | | | |
|---|---|---|---|---|
| 465,057 A | | 12/1891 | Foley | |
| 562,303 A | * | 6/1896 | Kaiser | A45D 40/20 401/51 |
| 627,279 A | | 6/1899 | Stassart | |
| 965,235 A | | 7/1910 | Selleck | |
| 1,200,575 A | | 10/1916 | Barrows | |
| 1,214,996 A | | 2/1917 | Boye | |
| 1,327,038 A | | 1/1920 | Hamilton | |
| 1,382,047 A | | 6/1921 | Allsworth | |
| 1,719,976 A | | 7/1929 | Grimmer | |
| 1,849,914 A | | 3/1932 | Delvin | |
| 2,069,619 A | | 2/1937 | Mendelson | |
| 2,333,714 A | | 11/1943 | Fletcher | |
| 2,507,089 A | * | 5/1950 | Bridges | B43K 29/06 30/451 |
| 2,512,208 A | | 6/1950 | Kuper | |
| 2,680,426 A | | 6/1954 | Kohut | |
| 2,757,638 A | | 8/1956 | Goldstein | |
| 3,039,436 A | | 6/1962 | Exner | |
| 3,399,945 A | | 9/1968 | Gouget | |
| 3,850,531 A | | 11/1974 | Ackermann | |
| 4,459,056 A | | 7/1984 | Getgey et al. | |
| 4,755,074 A | * | 7/1988 | Roberts | B43K 29/02 144/28.11 |

(Continued)

FOREIGN PATENT DOCUMENTS

| | | | |
|---|---|---|---|
| CH | 302058 A | 9/1954 | |
| DE | 857915 C | 12/1952 | |

(Continued)

*Primary Examiner* — David Walczak
(74) *Attorney, Agent, or Firm* — Renner, Otto, Boisselle & Sklar, LLP.

(57) ABSTRACT

A writing device includes a body having a main axis, the body having a bore formed therein, the bore having a bore axis oblique to the main axis, and a sharpener blade operatively attached to the body at least partially within the bore, such that a pencil is insertable into the bore of the body to be sharpened by the sharpener blade.

19 Claims, 5 Drawing Sheets

(56) References Cited

U.S. PATENT DOCUMENTS

| | | | | |
|---|---|---|---|---|
| 5,205,664 | A | 4/1993 | Yushan et al. | |
| 5,599,123 | A | 2/1997 | Still | |
| D402,314 | S | 12/1998 | Lidle et al. | |
| D411,236 | S | 6/1999 | Maldonado | |
| 6,257,789 | B1 | 7/2001 | Podszuweit et al. | |
| 6,830,404 | B2 * | 12/2004 | Nagaoka | G06F 1/1626 345/179 |
| 6,854,913 | B2 | 2/2005 | Farrell et al. | |
| 7,143,516 | B2 | 12/2006 | Sterios | |
| 7,458,947 | B2 | 12/2008 | Farrell et al. | |
| 7,500,322 | B2 | 3/2009 | Brown | |
| D598,497 | S | 8/2009 | Koch et al. | |
| 7,601,130 | B2 | 10/2009 | Farrell et al. | |
| D608,895 | S | 1/2010 | Farrell et al. | |
| 7,832,108 | B2 | 11/2010 | Sterios-Primiani | |
| 7,892,194 | B2 | 2/2011 | Farrell et al. | |
| 8,328,743 | B2 | 12/2012 | Farrell et al. | |
| 8,328,744 | B2 | 12/2012 | Farrell et al. | |
| 2011/0179655 | A1 | 7/2011 | Lemieux | |

FOREIGN PATENT DOCUMENTS

| | | | |
|---|---|---|---|
| EP | 1034943 | A1 | 9/2000 |
| EP | 1034943 | B1 | 7/2003 |
| FR | 1029451 | A | 6/1953 |
| FR | 2846912 | A1 | 5/2004 |
| GB | 679264 | A1 | 9/1952 |

* cited by examiner

WRITING DEVICE WITH PENCIL SHARPENER BUILT THEREIN

FIELD OF THE INVENTION

The present disclosure relates generally to writing devices such as conventional and mechanical pencils. More particularly, the present disclosure relates to a writing device that has a pencil sharpener built therein.

BACKGROUND

Pencils, particularly conventional pencils but also some types of mechanical pencils, need sharpen to write sharply and neatly. Before the development of dedicated pencil sharpeners, a pencil was sharpened by whittling it with a knife. Pencil sharpeners made this task much easier and gave a more uniform result than a knife. A pencil sharpener sharpens a pencil's writing point by shaving away its surface.

The first American pencil sharpener was patented by Walter K. Foster of Bangor, Me. in 1855. They now come in a wide array of colors and shapes.

Manual sharpeners have no moving parts and consist of a combined point-shaping cone that is aligned to the cylindrical pencil alignment guide hole, into which the pencil is inserted. A sharp blade is mounted so that its sharp edge just enters the shaping cone. The pencil is inserted into the sharpener and rotated while the sharpener is held motionless. The body of the sharpener is often contoured, ridged or grooved to make the small block easier to firmly grip.

The blade inside the sharpener shaves the wood and tip of the pencil, while the shavings emerge through a slot along the blade edge. It may be important that the cylindrical alignment hole closely fit the diameter of the pencil to keep the pencil from wobbling; causing stepped or lurching cut-depths and point breakage.

Conventionally, pencil sharpeners were independent of the pencil, requiring users to search for sharpeners when a pencil needs sharpening. This may be inconvenient. In addition, used pencils reaching certain lengths were considered unusable for being too short and became discarded. This is wasteful. The present invention integrates a pencil sharpener into a writing device such as a pencil so as to increase convenience for the users and reduce waste by utilizing portions of pencils that were thought to be unusable.

SUMMARY OF THE INVENTION

This disclosure provides a writing device that has a pencil sharpener built in within its body. A bore is formed within the body of the writing device and a sharpener blade attaches to the body in relationship to the bore. A user may insert the pencil's tip into the bore and sharpen it by rotating the pencil. The sharpener blade shaves the wood and core tip of the pencil, while the shavings emerge from a groove arranged at a side of the writing device. The inner surface of the bore keeps the pencil steady relative to the writing device while being sharpened.

In one embodiment, the writing device includes a tip at one end, a dome at the other end or both that are conductive and electrically or capacitively connected to a coating of the writing device. Therefore, when a user holds the writing device, the user may use the tip at one end, the dome at the other end or both as a stylus to be used as input device for touchscreen-enabled devices.

These and further features of the present invention will be described with reference to the attached drawings. In the description and drawings, particular embodiments of the invention have been disclosed in detail as being indicative of some of the ways in which the principles of the invention may be employed, but it is understood that the invention is not limited correspondingly in scope. Rather, the invention includes all changes, modifications and equivalents coming within the terms of the appended claims.

BRIEF DESCRIPTION OF THE DRAWINGS

The accompanying drawings, which are incorporated in and constitute a part of the specification, illustrate various example systems, methods, and so on, that illustrate various example embodiments of aspects of the invention. It will be appreciated that the illustrated element boundaries (e.g., boxes, groups of boxes, or other shapes) in the figures represent one example of the boundaries. One of ordinary skill in the art will appreciate that one element may be designed as multiple elements or that multiple elements may be designed as one element. An element shown as an internal component of another element may be implemented as an external component and vice versa. Furthermore, elements may not be drawn to scale.

DETAILED DESCRIPTION

Figure 4:
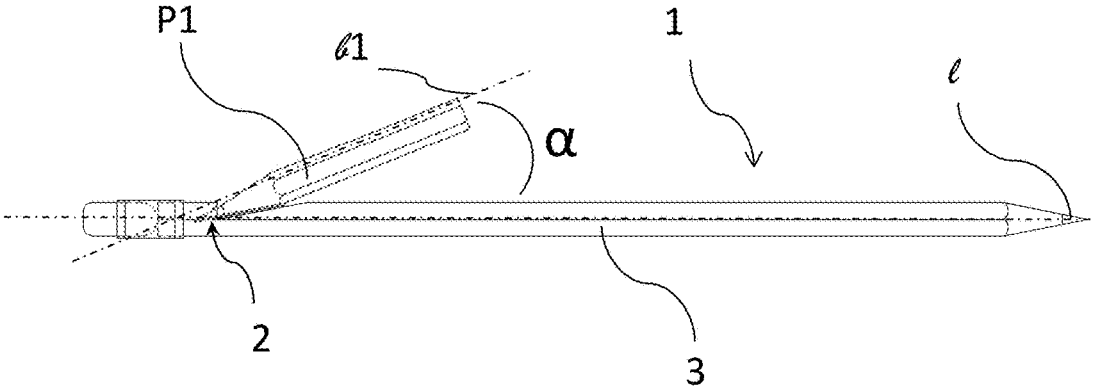
FIG. 4 illustrates a side view of an exemplary writing device with a pencil being sharpened using the pencil sharpener built within the body of the writing device.

FIGS. 1-5 illustrate an exemplary writing device 1. The writing device 1 has a pencil sharpener 2 built into its body 3. This way, as shown in FIG. 4, a user may sharpen a pencil P1 using the sharpener 2 built into the writing device 1. Although the illustrated writing device 1 is shown as resembling a conventional pencil in the drawings, the writing device 1 may resemble writing devices other than a conventional pencil such as a pen, a mechanical pencil, etc.

Figure 1:
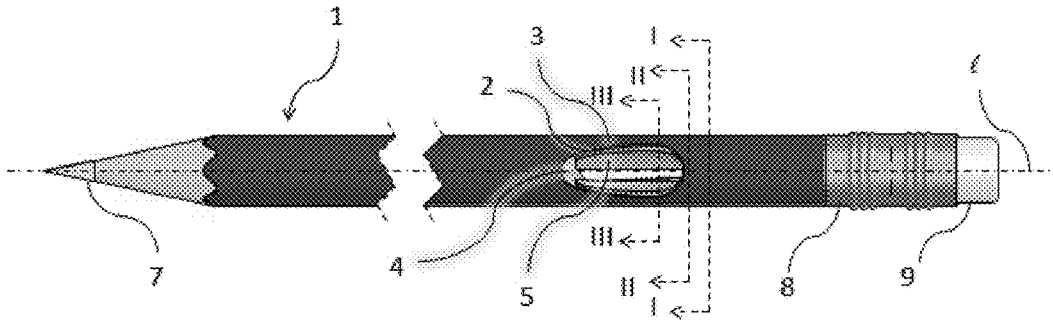
FIG. 1 illustrates a top view of an exemplary writing device.
Figures 1A, 1B, 1C:
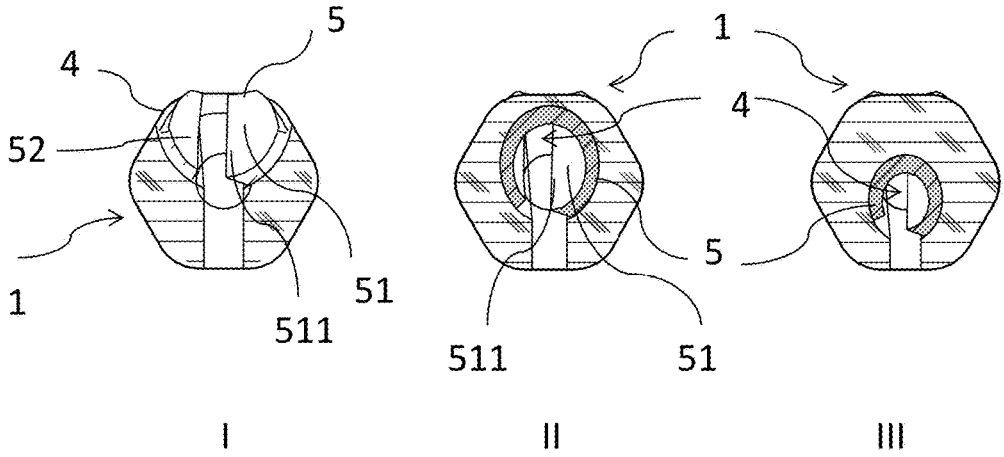
FIGS. 1A-C illustrate sectional views of the writing device with a sharpener built therein.
Figure 2:
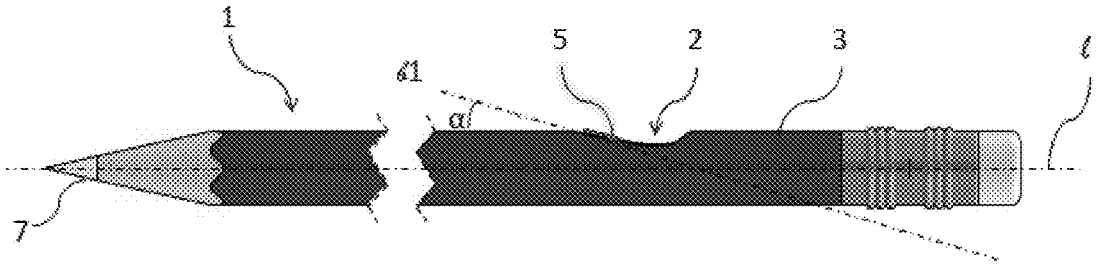
FIG. 2 illustrates a front view of the exemplary writing device.
Figure 3:
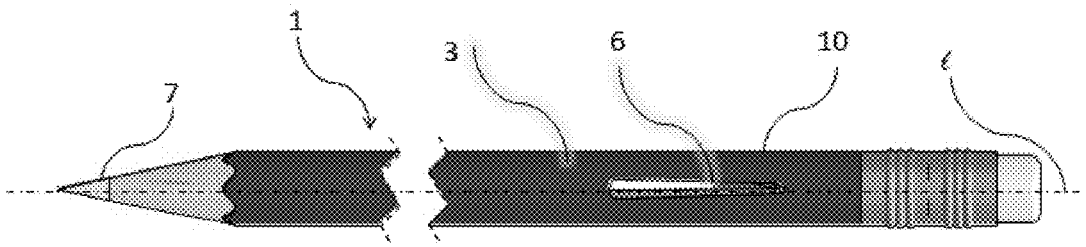
FIG. 3 illustrates a bottom view of the exemplary writing device.

The writing device 1 has a bore 4 formed in the body 3. The bore 4 is in a shape of a modified cone. As shown in FIGS. 2 and 4, the bore 4 is formed in the body 3 at an oblique angle $\alpha$ relative to a main axis l of the writing device 1. In other words, the bore 4 has a bore axis b1 (i.e., the axis of the modified cone) that is oblique to the main axis l. The angle $\alpha$ may be from 5° to 85°.

The writing device 1 also includes a sharpener blade 5 that is operatively attached to the body 3 at least partially within the bore 4. The writing device 1 further includes a groove 6 on a surface of the writing device 1. The groove 6 allows sharpener shavings to exit.

A user may insert the tip of the pencil P1 into the bore 4 and sharpen the tip by rotating the pencil P. The sharpener blade 5 shaves the wood and core tip of the pencil P1 while the shavings emerge from the groove 6. The inner surfaces of the bore 4 keep the pencil P1 steady relative to the writing device 1 while being sharpened.

In the illustrated embodiment, the writing device 1 is a pencil and thus the writing device 1 includes a solid pigment core 7 (i.e., graphite) disposed inside the body 3 along or parallel the main axis l. In other embodiments, the writing device 1 is a writing device other than a pencil (e.g., pen, mechanical pencil, etc.) or a pencil that has a solid pigment core other than graphite (an example of which is disclosed in detail below) disposed inside the body 3 along or parallel the main axis l.

Figure 6A:
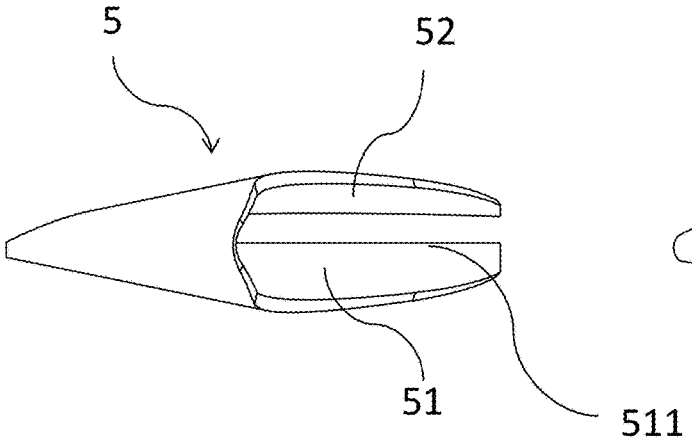
FIG. 6A illustrates a magnified top view of the exemplary sharpener blade.
Figure 6B:
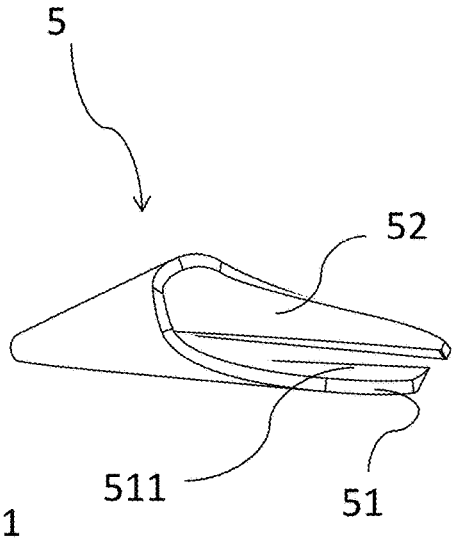
FIG. 6B illustrates a magnified perspective view of the exemplary sharpener blade.
Figure 6C:
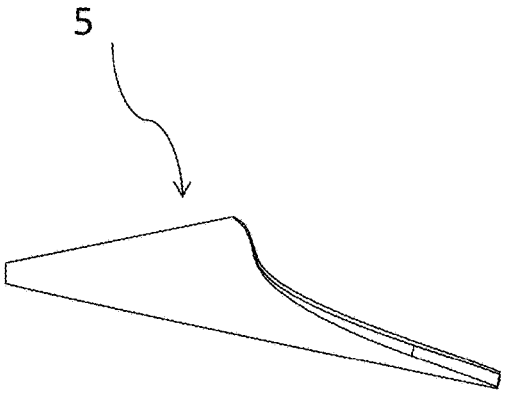
FIG. 6C illustrates a magnified front view of the exemplary sharpener blade.
Figure 6D:
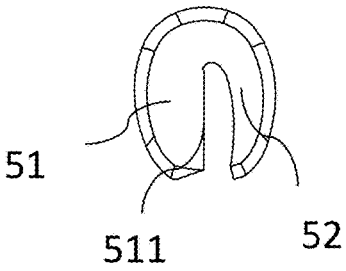
FIG. 6D illustrates a magnified side view of the exemplary sharpener blade.

As illustrated in FIGS. 6A-6C, the sharpener blade 5 is in a shape of a modified oblique cone and has two arms 51, 52 extending from one end of the sharpener blade 5 rearward away from the vertex of the cone. The two arms 51, 52 extend in parallel to each other with a space in between. One arm 51 has a flat surface on which the pencil P1 to be sharpened lies and the flat surface has a sharpening edge 511 for sharpening a pencil. The other arm is configured to guide sharpening of the pencil P1 and maintain stability for the pencil P1 when the pencil P1 is being sharpened.

Figure 5:
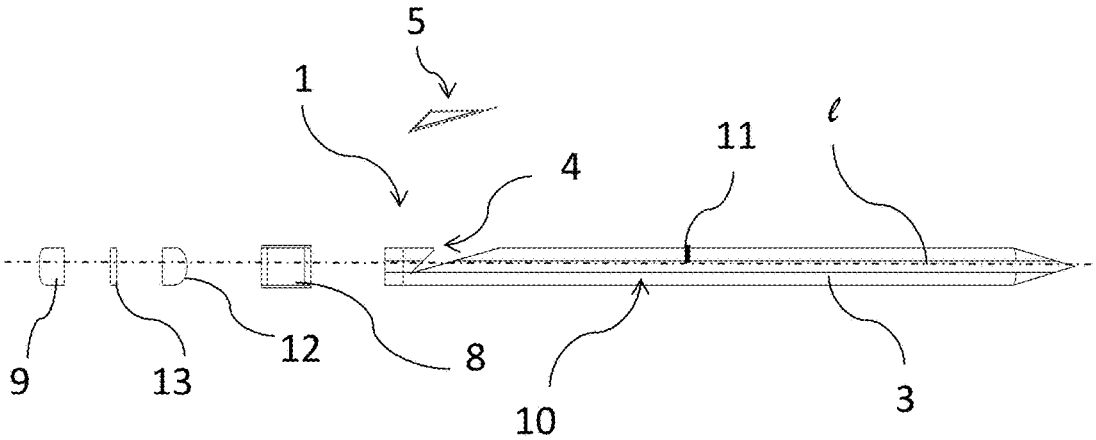
FIG. 5 illustrates an exploded view of the exemplary writing device.

In the illustrated embodiment and as best shown in the exploded view of FIG. 5, the writing device 1 also includes a collar 8 mounted at one end of the body 3. The collar 8 has a first opening that mounts to or receives the body 3. The writing device 1 may also include an eraser 9. In the illustrated embodiment, the collar 8 has a second opening that receives the eraser 9. This way, the eraser 9 may be attached to the writing device 1. In one embodiment, the writing device 1 does not include the collar 8 and/or the eraser 9 may be mounted to the writing device 1 by means (e.g., adhesive) other than the collar 8.

In one embodiment, the writing device 1 includes an electrically conductive layer 10 (e.g., sprayed on metal, film, etc.) that coats at least some of the exterior of the body 3. In one embodiment, the solid pigment core 7 of the writing device 1 may also be electrically conductive (e.g., metal-infused graphite, etc.) and may be electrically or capacitively connected to the electrically conductive layer 10. The solid pigment core 7 may be electrically or capacitively connected to the electrically conductive layer 10 via a metallic connection 11 (shown in FIG. 5). When a user holds the writing device 1 with his hand, electrical or capacitive contact between the user's hand and the tip of the core 7 allows the user to use the writing device 1 as a thin stylus that can be used as input device for touchscreen-enabled devices.

In one embodiment, the writing device 1 includes an electrically conductive elastomeric dome 12 best shown in FIG. 5. The collar 8 may receive the dome 12 in its second opening to attach it to the writing device 1. The dome 12 may be electrically or capacitively connected to the electrically conductive layer 10. When a user holds the writing device 1 with his hand, electrical or capacitive contact between the user's hand and the dome 12 allows the user to use the writing device 1 as a thick stylus that can be used as input device for touchscreen-enabled devices.

Thus, the writing device 1 may be used as a thin or a thick stylus depending on the user's needs.

In the illustrated embodiment of FIG. 5, the writing device 1 includes both the eraser 9 and the dome 12. In such an embodiment, the writing device 1 may include a magnet 13 attached to each of the eraser 9 and the dome 12. The collar 8 may be made of a magnetic material such that the assembly formed by the eraser 9, the dome 12 and the magnet 13 may be retained within the second opening of the collar 8 by the magnetic connection between the magnet 13 and the collar 8. A user may pull the assembly formed by the eraser 9, the dome 12 and the magnet 13 from the second opening of the collar 8 by breaking the magnetic force between the magnet 13 and the collar 8. This way, the user may reversibly choose whether to use the eraser 9 or the dome 12. In this embodiment, the electrical or capacitive connection between the dome 12 and the electrically conductive layer 10 of the writing device 1 may be provided through the collar 8 and the magnet 13.

Figure 7:
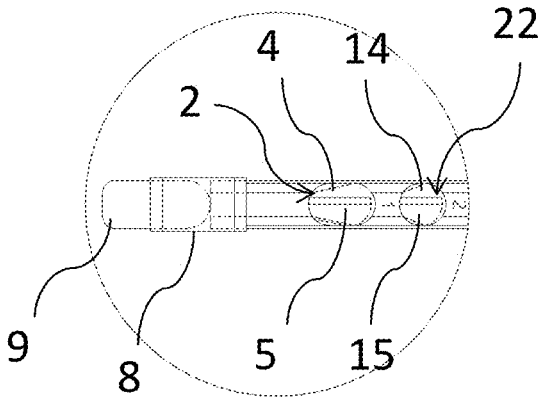
FIG. 7 illustrates a front view of an exemplary writing device that has two sharpeners built therein.
Figure 8:
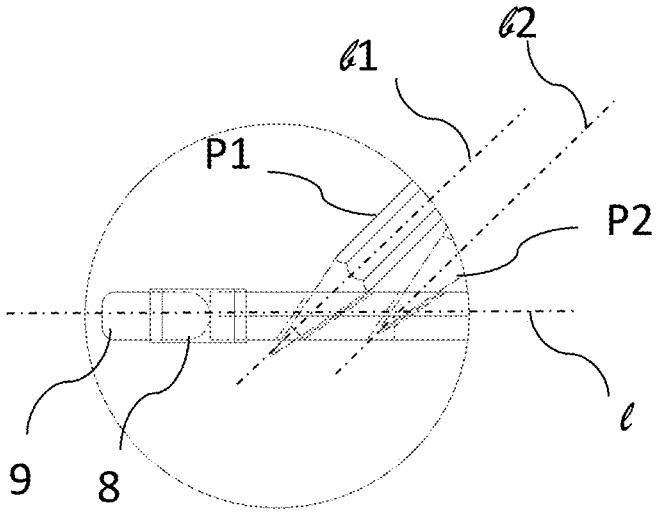
FIG. 8 illustrates a side view of the exemplary writing device that has two sharpeners built therein.

FIGS. 7 and 8 illustrate an exemplary embodiment of the writing device 1 in which the body 3 has a second bore 14 in addition to the first bore 4 formed therein and a pencil P2 being sharpened using a second sharpener 22 built within the body 3 of the writing device 1. Similar to the first bore 4, the second bore 14 is formed in the body 3 at an oblique angle relative to a main axis l of the writing device 1. In other words, the second bore 14 has a bore axis b2 that is oblique to the main axis l of the body 3.

In the illustrated embodiment, the writing device 1 also includes the second sharpener blade 15 operatively attached to the body 3 at least partially within the second bore 14. In the illustrated embodiment, the second bore 14 has a smaller diameter than a diameter of the first bore 4. This way, the sharpener 2 formed by the first bore 4 and the blade 5 may be used to sharpen thicker pencils or the thicker portion of the body of a pencil and the sharpener 22 formed by the bore 14 and the blade 15 may be used to sharpen thinner pencils or just the tip of a pencil.

While example systems, methods, and so on, have been illustrated by describing examples, and while the examples have been described in considerable detail, it is not the intention to restrict or in any way limit the scope of the appended claims to such detail. It is, of course, not possible to describe every conceivable combination of components or methodologies for purposes of describing the systems, methods, and so on, described herein. Additional advantages and modifications will readily appear to those skilled in the art. Therefore, the invention is not limited to the specific details, and illustrative examples shown or described. Thus, this application is intended to embrace alterations, modifications, and variations that fall within the scope of the appended claims. Furthermore, the preceding description is not meant to limit the scope of the invention. Rather, the scope of the invention is to be determined by the appended claims and their equivalents.

To the extent that the term "includes" or "including" is employed in the detailed description or the claims, it is intended to be inclusive in a manner similar to the term "comprising" as that term is interpreted when employed as a transitional word in a claim. Furthermore, to the extent that the term "or" is employed in the detailed description or claims (e.g., A or B) it is intended to mean "A or B or both". When the applicants intend to indicate "only A or B but not both" then the term "only A or B but not both" will be employed. Thus, use of the term "or" herein is the inclusive, and not the exclusive use. See, Bryan A. Garner, A Dictionary of Modern Legal Usage 624 (3D. Ed. 1995).

What is claimed is:

1. A writing device comprising:

a body having a first end and a second end aligned along a main axis of the body and a solid pigment core disposed inside the body along the main axis, the body having a bore formed therein between the first end and the second end, the bore having a bore axis oblique to the main axis; and a sharpener blade operatively attached to the body at least partially within the bore, such that a pencil different from the writing device is insertable into the bore of the body to be sharpened by the sharpener blade.

2. The writing device of claim 1, wherein a groove is arranged on a surface of the writing device, the surface allows shavings of the pencil being sharpened to exit.

3. The writing device of claim 2, wherein the sharpener blade having a shape of a modified oblique cone from one end of which two arms extend rearward away from a vertex of the modified oblique cone and in parallel to each other with a space in between, the groove being configured to allow pencil shavings to exit, one of the two arms has a blade with a flat surface, the flat surface having a sharpening edge capable of removing wood and refining a lead of the pencil, and the other arm is configured to guide sharpening of the pencil and maintain stability when the pencil is being sharpened.

4. The writing device of claim 1, comprising:

an electrically conductive layer coating at least some of an exterior of the body.

5. The writing device of claim 4, comprising:

a solid pigment core that is electrically conductive disposed inside the body along the main axis and electrically or capacitively connected to the electrically conductive layer.

6. The writing device of claim 4, comprising:

a collar mounted at an end of the body, the collar having a first opening opposite a second opening that receives a portion of the body; and an electrically conductive elastomeric dome received by the first opening of the collar and electrically or capacitively connected to the electrically conductive layer.

7. The writing device of claim 6, wherein the electrically conductive elastomeric dome is part of a reversible assembly that includes the electrically conductive elastomeric dome at one end and an eraser at the other end, the reversible assembly being reversibly installable to the collar such that, in a first configuration, the electrically conductive elastomeric dome is disposed at an extreme end of the writing device and, in a second configuration, the eraser is disposed at the extreme end of the writing device.

8. The writing device of claim 4, comprising:

an electrically conductive elastomeric dome received at an end of the body and electrically or capacitively connected to the electrically conductive layer.

9. The writing device of claim 1, the body having a second bore formed therein, the second bore having a second bore axis oblique to the main axis; and a second sharpener blade operatively attached to the body at least partially within the second bore, such that a lead tip of the pencil or a second pencil is insertable into the second bore of the body to be sharpened by the second sharpener blade.

10. The writing device of claim 1, the body having a second bore formed therein, the second bore having a second bore axis oblique to the main axis; and a second sharpener blade operatively attached to the body at least partially within the second bore, such that a second pencil different from the pencil is insertable into the second bore of the body to be sharpened by the second sharpener blade, the second bore having a smaller diameter than a diameter of the bore.

11. A pencil comprising:

a body having a main axis, a non-writing end, and a writing end, the non-writing end and the writing end aligned along the main axis;

a solid pigment core disposed inside the body parallel to the main axis;

a cavity formed between the non-writing end and the writing end along and into the body at an oblique angle to the main axis; and a sharpener blade operatively attached to the body at least partially inside the cavity, such that a second pencil different from the pencil is insertable into the cavity to be sharpened by the sharpener blade.

12. The pencil of claim 11, comprising:

an electrically conductive layer coating at least some of an exterior of the body.

13. The pencil of claim 12, wherein the solid pigment core is electrically conductive and electrically or capacitively connected to the electrically conductive layer.

14. The pencil of claim 12, comprising:

a collar mounted at an end of the body, the collar having a first opening opposite a second opening that receives a portion of the body; and an electrically conductive elastomeric dome received by the first opening of the collar and electrically or capacitively connected to the electrically conductive layer.

15. The pencil of claim 14, wherein the electrically conductive elastomeric dome is part of a reversible assembly that includes the electrically conductive elastomeric dome at one end and an eraser at the other end, the reversible assembly being reversibly installable to the collar such that, in a first configuration, the electrically conductive elastomeric dome is disposed at an extreme end of the pencil and, in a second configuration, the eraser is disposed at the extreme end of the pencil.

16. The pencil of claim 12, comprising:

an electrically conductive elastomeric dome received at an end of the body and electrically or capacitively connected to the electrically conductive layer.

17. The pencil of claim 11, the body having a second cavity formed along and into the body at an oblique angle to the main axis; and a second sharpener blade operatively attached to the body at least partially inside the second cavity, such that a lead tip of the second pencil or of a third pencil is insertable into the second cavity to be sharpened by the second sharpener blade.

18. The pencil of claim 11, the body having a second cavity formed along and into the body at an oblique angle to the main axis; and a second sharpener blade operatively attached to the body at least partially inside the second cavity, such that the second pencil or a third pencil is insertable into the second bore of the body to be sharpened by the second sharpener blade, the second cavity having a smaller diameter than a diameter of the cavity.

19. A pencil comprising:

a body having a first end and a second end aligned along a main axis, the body having a bore formed therein between the first end and the second end, the bore having a bore axis oblique to the main axis;

a solid pigment core disposed inside the body along the main axis; and a sharpener blade operatively attached to the body at least partially within the bore, such that a second pencil different from the pencil is insertable into the bore of the body to be sharpened by the sharpener blade.

* * * * *